US005584187A

United States Patent [19]

Whaley

[11] Patent Number: 5,584,187

[45] Date of Patent: Dec. 17, 1996

[54] QUICK-CHILL BEVERAGE CHILLER

[76] Inventor: Glenn E. Whaley, 1008 S. Berry, Burkburnett, Tex. 76354

[21] Appl. No.: 372,662

[22] Filed: Jan. 13, 1995

[51] Int. Cl.[6] ..... F25B 21/02

[52] U.S. Cl. ..... 62/237; 62/376; 62/458; 62/373

[58] Field of Search ..... 62/64, 237, 371, 62/373, 376, 457.1, 457.2, 457.5, 457.9, 458

[56] References Cited

U.S. PATENT DOCUMENTS

| | | | |
|---|---|---|---|
| 2,214,009 | 9/1940 | Boester | 62/376 |
| 2,915,884 | 12/1959 | Haushalter et al. | 62/237 |
| 3,006,774 | 10/1961 | Zebarth | 62/64 |
| 4,103,510 | 8/1978 | Hall | 62/299 |
| 4,541,251 | 9/1985 | Louradour et al. | 62/64 |
| 5,111,664 | 5/1992 | Yang | 62/3.62 |
| 5,191,773 | 3/1993 | Cassell | 62/373 |
| 5,237,835 | 8/1993 | Brochier | 62/376 |
| 5,267,448 | 12/1993 | Van Den Heuvel | 62/64 |
| 5,267,490 | 12/1993 | Howells | 73/863.52 |
| 5,423,191 | 6/1995 | Bennett | 62/201 |

FOREIGN PATENT DOCUMENTS

| | | | |
|---|---|---|---|
| 0174170 | 3/1986 | European Pat. Off. . | |
| 2176551 | 3/1972 | France . | |
| 2034496 | 1/1972 | Germany . | |
| 3002260 | 7/1981 | Germany | 62/457.9 |
| 4023781 | 2/1991 | Germany | 62/457.9 |
| 1541905 | 3/1979 | United Kingdom . | |

*Primary Examiner*—Henry A. Bennett
*Assistant Examiner*—William C. Doerrler
*Attorney, Agent, or Firm*—Richard C. Litman

[57] ABSTRACT

A refrigeration plant having an associated but detachable receptacle for receiving chilled liquid. The refrigeration plant and receptacle are connected by manually detachable hoses to complete a recirculation system for the chilled liquid. The receptacle is insulated and portable. Beverage cans or other containers can be placed and chilled in the receptacle, and transported to another location. When additional containers are placed in the receptacle to replace those removed for consumption, the receptacle is reconnected to the refrigeration plant. The chilled liquid, which also chills the containers, is then renewed. An aqueous solution including a freeze point depressant, or plain water, is suitable for the chilled liquid. The refrigeration plant preferably includes a strainer and a flow control valve. The receptacle is preferably insulated and open at the top, and also may have a cover. The receptacle may also be provided with dividers to define compartments for segregating, for example, fully chilled and still warm containers. Food containers may thus be chilled and served remotely from the refrigeration plant. Alternatively, the receptacle may be stationary but remote, for example, being formed permanently in a bar, with the refrigeration plant located out of sight. In another alternative embodiment, the receptacle may be enclosed, in the manner of a residential refrigerator. The refrigeration plant, if of sufficient capacity, can serve a plurality of receptacles, renewing chilling medium of one receptacle while others are in use.

20 Claims, 2 Drawing Sheets

QUICK-CHILL BEVERAGE CHILLER

BACKGROUND OF THE INVENTION

1. Field of the Invention

The present invention relates to a quick-chill device employing a refrigeration plant connected to a receptacle by manually detachable hoses. The receptacle is filled with chilled liquid from the refrigeration plant, and, in turn, chills food or beverage containers placed therein. The receptacle can be moved to a remote location, and maintain the containers chilled for extended periods, then be refilled with fresh chilled liquid.

2. Description of the Prior Art

A plethora of large public events today require bulk food products to be served at chilled temperatures. Traditionally this has been accomplished by producing or importing large quantities of ice to the site to be served. Alternatively, large air cooled refrigeration units have been employed to cool the foodstuffs. These conventional foodstuff coolers generally lack sufficient cooling capacity to quickly chill an ever-changing foodstuff supply. Additionally, the refrigeration plant typically is typically bulky, and objectionably so for such public gatherings. The ice based method requires large quantities of ice, and further creates problems with the water by-product. All in all, these methods are not cost and space effective in serving the public at large.

One attempt to meet the need of serving public gatherings is seen in U.S. Pat. No. 5,267,448, issued to Ronald W. Van Den Heuvel on Dec. 7, 1993. The device described therein includes a refrigeration plant and a chilled liquid bath. Racks are loaded with beverage containers, immersed in the chilled bath, then removed for dispensing the containers. However, containers must be immediately consumed, or they will begin to warm, since the racks have no means for cooling. It is an important feature of the present invention to overcome this limitation.

Refrigerated apparatus having immersion bath chilling for food containers are seen in U.S. Pat. No. 5,191,773, issued to Allan J. Cassell on Mar. 9, 1993, 5,237,835, issued to Yves Brochier on Aug. 24, 1993, and EPO Pat. Publication No. 0,174,170, dated Mar. 12, 1986. Cassell features a circulation system, and Brochier describes an insulated reservoir. In each of these examples, the receptacle receiving individual food containers and the chilling medium is integral with and not removable or remote from the device.

Another example is shown in French Pat. Application No. 2,176,551, dated Mar. 23, 1972. The chilling medium is an aqueous solution including glycol, methanol, and butanol.

Additional food chilling apparatuses are shown in U.S. Pat. No. 5,267,490, issued to Roger A. Howell on Dec. 7, 1993, and U.K. Patent Application No. 1,541,905, dated Mar. 14, 1979. Howell features openings or ports, which also occur in the present invention. However, Howell's ports are for extracting samples rather than for extension of a chilling medium circuit. The U.K. patent describes a temperature maintenance system. The system described therein is considerably different from the present invention.

None of the above inventions and patents, taken either singly or in combination, is seen to describe the instant invention as claimed.

SUMMARY OF THE INVENTION

The present invention provides a chiller which incorporates a refrigeration plant and a detachable chilling tray or storage receptacle. The receptacle performs three functions:

chilling beverage containers placed therein, maintaining these containers chilled, and dispensing the chilled containers.

The receptacle is filled with a chilled liquid, which circulates around the containers, cooling the same. Constant circulation of the liquid assures that when the receptacle is detached from the refrigeration plant, a substantial thermal mass is present to maintain the beverages at or about a desired temperature. The receptacle is then taken to the point of consumption or dispensation for the consumers to remove the containers for consumption.

It is anticipated that large public gatherings will provide a typical use for this invention. The prior art has generally recognized the problems associated with serving chilled beverages to large numbers of people. However, the prior art has not fully appreciated the combination of chilling and maintaining beverages chilled, and also employing the storage receptacle for display and dispensation.

While a first receptacle serves the public, a second receptacle is loaded with containers, and chills the same. A progression of receptacles can be employed in a cycle, so that there is always at least one chilled container available to the consumers, while at least one second container is constantly ready to replenish the supply thereof. This scheme enables one or more points of consumption to be served and immediately replenished as needed.

This process entails minimal requirement for chilled liquid for two reasons. One reason is that there is no large reservoir of liquid which must chill a large number of containers simultaneously. The second reason is that liquid is recycled rather than discarded, although some loss due to spillage is inevitable.

Additional advantages accrue from being able to transport the storage receptacles. The bulky and unsightly refrigeration plant can be advantageously located away from the activity at which drinks are being served, while the individual storage receptacles can be located proximate to the activity, and easily returned for replenishment.

The refrigeration plant and storage receptacles are provided with ports for connection of hoses conducting the chilling liquid to the receptacle and back to the refrigeration plant. Connection is manual, so that receptacles are readily detached and are immediately deployed.

In another embodiment of the invention, the receptacles are stationary, but still remote from the refrigeration plant. An example is a chilling tray formed permanently in a bar.

The refrigeration plant includes features such as temperature controls, a flow switch, and a strainer for maintaining the circulated liquid free of solid contamination. The receptacles are insulated, open at the top, and optionally include covers. Large receptacles are provided with dividers for separating warm, recently loaded beverage containers from chilled containers. Struts for bracing the dividers are also provided.

The preferred chilling medium is water, or an aqueous solution including a freezing point depressant. The freezing point depressant is preferably a mixture of glycols.

Accordingly, it is a principal object of the invention to provide a refrigeration apparatus which includes a refrigeration plant and a remote receptacle for holding and chilling individual beverage containers, and maintaining the latter chilled.

It is another object of the invention to enable ready connection and disconnection of the remote receptacle from the refrigeration plant.

It is a further object of the invention to establish a chilling medium recirculation scheme, so that spent or heated chilling medium is immediately returned to the refrigeration plant after accepting heat from the articles being chilled, and fresh or fully cooled chilling medium is immediately supplied to the receptacle to assist in maintaining the lowered temperature of the articles being chilled.

Still another object of the invention is to minimize water and ice consumption of a beverage chilling apparatus.

An additional object of the invention is to control the flow rate of the recirculation system.

A further object of the invention is to cleanse the chilling medium.

Yet another object of the invention is to provide a chilling medium which is a nonionic aqueous solution.

It is still an additional object of the invention to provide a chilling medium which has a freezing point below that of water.

It is again an object of the invention to provide a receptacle for displaying and dispensing beverage containers, which is open at the top to facilitate loading and dispensing, and insulated to maintain reduced temperatures within.

A further object of the invention is to divide the receptacle into several compartments, for segregating groups of beverage containers.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
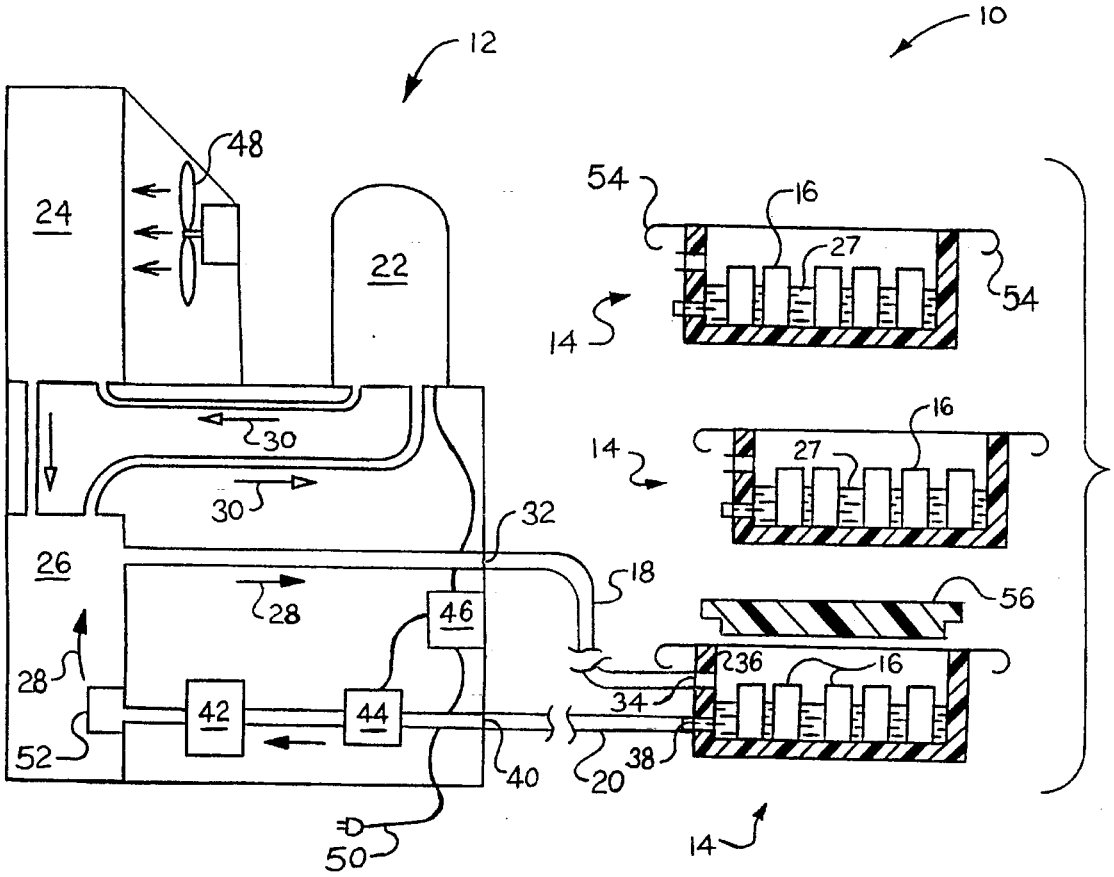
FIG. 1 is a diagrammatic, side cross sectional view of a first embodiment of the invention, wherein the container receptacle is a portable tray.

FIG. 1 shows the principal components of the novel chilling apparatus 10. These components include a refrigeration plant 12, at least one storage receptacle 14 for holding beverage containers 16, and fluid conduits 18 (supply), 20 (return) for connecting refrigeration plant 12 to at least one storage receptacle 14. Refrigeration plant 12 includes any suitable chilling device, such as a vapor compression machine having a compressor 22 and a condensing coil 24. Still other devices, such as Peltier effect thermoelectric coolers, liquid absorption chillers, or still others, would serve equally well. A vapor compression machine is illustrated since this type of chiller is most frequently employed in refrigeration applications. Therefore, the vapor compression machine is understood to be representative, and will, if employed, further be understood to include various features conventionally furnished in vapor compression schemes even though not specifically shown. Such features include, illustratively, in-line dessicants, high and low temperature and pressure controllers, miscellaneous valves, restart delay timer, and overcurrent, undervoltage, and phase failure protective devices (not shown).

In addition to compressor 22 and condensing coil 24, refrigeration plant 12 includes a heat exchanger 26 which transfers heat from a liquid 27 serving as a chilling medium passing therethrough, indicated by arrows 28, to the refrigerant circuit, indicated by arrows 30.

The refrigerant circuit is conventional, and will not be discussed further. The chilling medium circuit extends from heat exchanger 26 to a supply port 32, where a supply conduit 18 is connected. Supply conduit 18 attaches to an inlet port 34 formed in the wall 36 of storage receptacle 14. Chilling medium is discharged into storage receptacle 14, and chills beverage containers 16. Receptacle 14 is made from an insulating material, such as an expanded foam resin.

The storage 14 receptacle also has an outlet port 38 to which return conduit 20 is attached, for the return of chilling medium to a return port 40 formed in the refrigeration plant 12. The medium is conducted to heat exchanger 26 for starting a new cycle.

Refrigeration plant 12 includes a strainer 42 for removing solid debris from the chilling medium, and a flow switch 44, which shuts off compressor 22 if insufficient flow is detected. A suitable controller 46, such as a relay, disconnects power to compressor 22 responsive to detection of insufficient flow. The electrical power source serving compressor 22 and condenser fan 48 is represented by cord 50. Any other suitable connection may also be employed to connect electrical power to compressor 22, such as a permanent wiring and an electrical conduit terminating in a junction box (none of these shown), as would be preferable for commercial applications employing three-phase power.

Chilling medium is circulated under pressure by pump 52 to a receptacle 14. Receptacle 14 is placed on a table or other supporting surface raised in the air so that chilling medium returns to refrigeration plant 12 by gravity.

Any number of receptacles 14 can be served by one refrigeration plant 12, as shown in FIG. 1. Manipulation of receptacle 14 for loading, connecting to the chilling circuit, or being transported to a location for consumption, is enabled by handles 54. Connection of conduits 18,20 includes plugs, valves, or flow controlling fittings (none shown), to prevent loss of chilling medium. Conduits 18,20 are preferably flexible hoses.

Receptacle 14 is one of several embodiments which are usable in the present invention. In this embodiment, receptacle 14 is open at the top for easy access for dispensing and reloading. A removable cover 56 for minimizing heat gain when a freshly prepared receptacle 14 awaits being made available to consumers.

Figure 2:
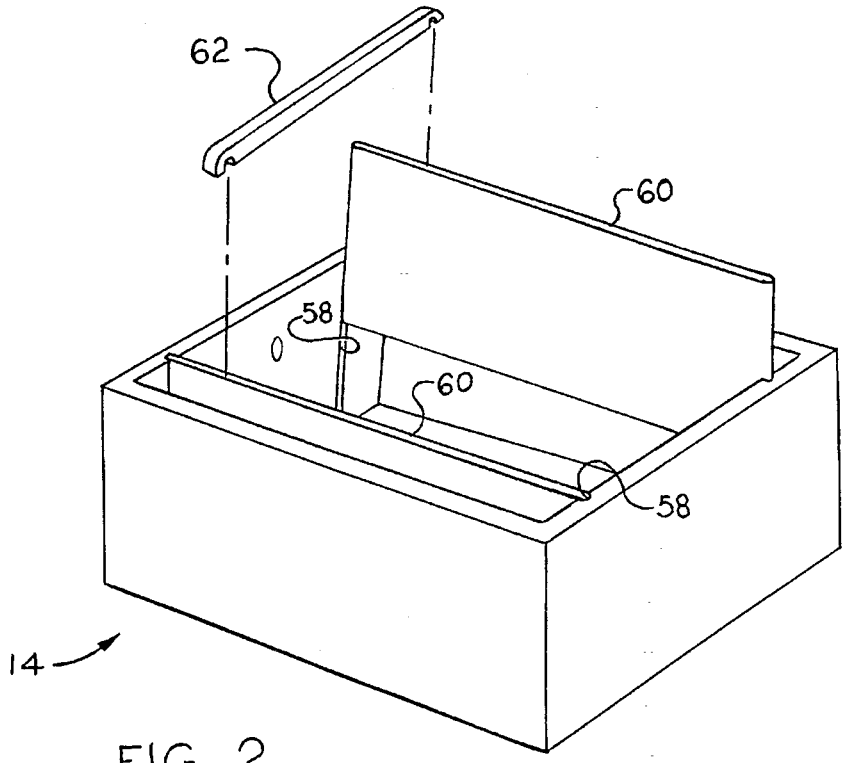
FIG. 2 is a partially exploded perspective view of the tray of FIG. 1, further showing optional dividers and a bracing strut for subdividing the tray.

As shown in FIG. 2, receptacle 14 has grooves 58 for slidably retaining dividers 60. Dividers 60 separate receptacle 14 into more than one compartment. This may be performed to segregate beverage containers by type, or to separate fully chilled containers from those which have not yet fully chilled. Where the compartments are excessively long, dividers 60 arranged abreast are secured by a brace or strut 62 which straddles two or more dividers 60.

Figure 3:
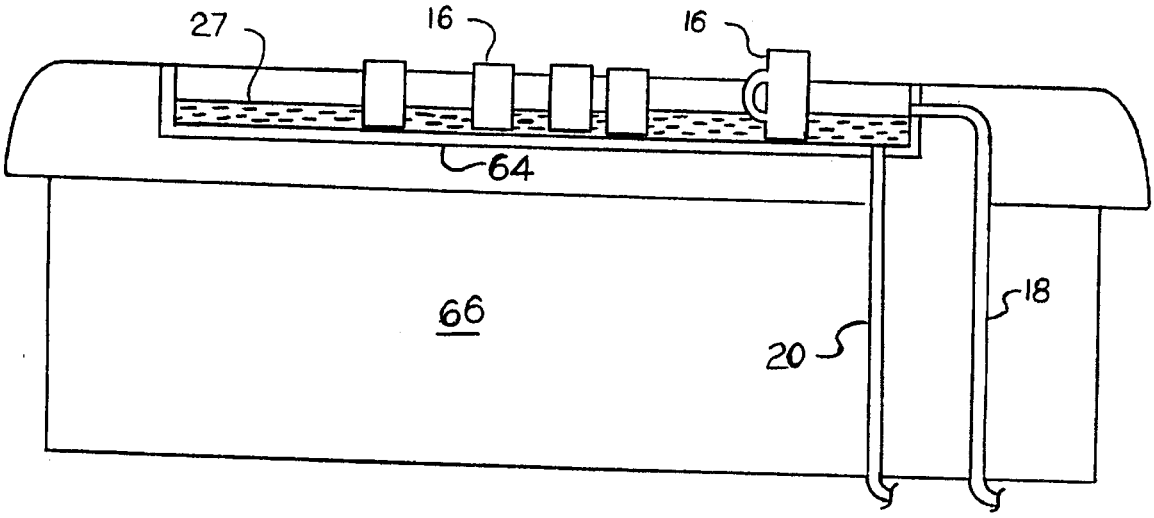
FIG. 3 is a diagrammatic, side elevational, partially cross sectional view of an alternative embodiment receptacle, wherein the receptacle is integral with a bar.
Figure 4:
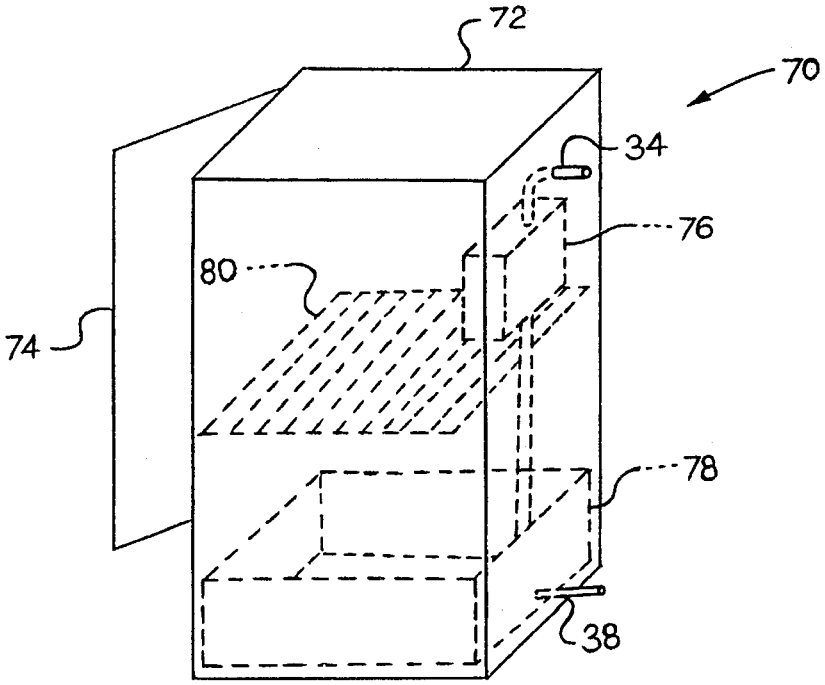
FIG. 4 is a diagrammatic, perspective view of another alternative embodiment receptacle, wherein the receptacle is enclosed in the manner of a residential refrigerator.

Turning now to FIGS. 3 and 4, it will be seen that the container storage receptacle may take additional forms. In FIG. 3, receptacle 64 remains open at the top and remote from refrigeration plant 12, but is stationary. In a typical application, receptacle 64 is made integral with a bar 66. Conduits 18,20 are, in this embodiment, concealed plumbing conduits. If one referigeration plant serves one receptacle 64, it is possible to make permanent connection of conduits 18,20 at the refrigeration plant (see FIG. 1), or the connection may be of the readily removable type.

FIG. 4 shows still another embodiment of the receptacle. In this embodiment, receptacle 70 comprises an enclosed insulated housing 72 having a door 74, in the manner of a residential refrigerator. A liquid to air heat exchanger 76 receives chilling medium from inlet port 34, and chills the interior of receptacle 70. Chilling medium passes to an open tank 78, in which beverage cans are placed. A rack or shelf 80 is used to store articles (not shown) which are chilled or maintained cool by exposure to cold air. Spent or heated chilling medium exits receptacle 70 through outlet port 38, and is recirculated as described above.

In a typical application, receptacle 70 would be employed by a restaurant, bar, or other permanent food service facility. Tank 78 operates in the manner of receptacle 14, and additional utility is provided by the large, enclosed interior of receptacle 70 in that other articles, which may be unwrapped or otherwise susceptible to damage if immersed in a liquid, may be chilled in addition to beverage containers.

It would further be possible to serve any number of stationary receptacle types simultaneously from one refrigeration plant, with minor modification to conduits 18,20. Thus, the present invention is usable in both temporary and permanent food facilities.

A preferred chilling medium is a solution including water and at least one glycol, such as alkyl glycol, alkylene glycols, and polyalkylene glycols. Particularly useful glycols include ethylene glycol and polyethylene glycol, due to cost, availability, suitable freezing point characteristics, and solubility in water.

It is to be understood that the present invention is not limited to the embodiments described above, but encompasses any and all embodiments within the scope of the following claims.

I claim:

1. A quick chilling apparatus for maintaining food containers chilled by a liquid coolant, comprising:

a refrigeration plant for chilling a liquid chilling medium, said refrigeration plant including a chilling medium circuit and means defining a chilling medium supply port for discharging said chilling medium;

multiple portable storage receptacles for receiving and storing food containers and said liquid chilling medium in heat exchange relation to said food containers placed therein, each of said multiple storage receptacles comprising a bottom wall and upstanding lateral walls enclosing a plurality of dividers arranged abreast for separating each said storage receptacle into at least three compartments, and at least one brace straddling said plurality of dividers for maintaining said dividers in place;

said each storage receptacle having means defining an inlet port for receiving said liquid chilling medium from said refrigeration plant; and means for manually enabling and disconnecting fluid communication between said supply port and said storage receptacle, whereby each said portable storage receptacle can be maintained at a chilling temperature while connected to said refrigeration plant and transported away from said refrigeration plant in a chilled condition to another location.

2. The quick chilling apparatus according to claim 1, said storage receptacle further including handles, whereby said storage receptacle is portable.

3. The quick chilling apparatus according to claim 1, wherein said means for enabling and disconnecting fluid communication comprising at least one supply conduit connectable to and removable from said supply port of said refrigeration plant and said inlet port of said storage receptacle, for providing a supply of chilled medium to said storage receptacle.

4. The quick chilling apparatus according to claim 2, wherein said refrigeration plant also having means defining a return port, said storage receptacle also having means defining an outlet port, and said means for enabling and disconnecting fluid communication further comprising a return conduit connectable to and removable from said outlet port of said storage receptacle and said return port of said refrigeration plant, whereby said chilling medium is recirculated.

5. The quick chilling apparatus according to claim 4, wherein said chilling medium circuit further including a flow switch disposed in series therewith for controlling said refrigeration plant responsive to detection of sufficient flow of chilling medium.

6. The quick chilling apparatus according to claim 4, wherein said chilling medium circuit further including a strainer disposed in series therewith to cleanse fluid flowing therein.

7. The quick chilling apparatus according to claim 1, wherein further including a chilling medium comprising a liquid including water.

8. The quick chilling apparatus according to claim 7, wherein said liquid further including a freeze point depressant depressing the freezing point of said liquid below that of water.

9. The quick chilling apparatus according to claim 8, wherein said freeze point depressant is selected from the group consisting of an alkyl glycol, an alkylene glycol, polyalkylene glycol, and mixtures thereof.

10. The quick chilling apparatus according to claim 8, wherein said freeze point depressant is selected from the group consisting of ethylene glycol, polyethylene glycol and mixtures thereof.

11. The quick chilling apparatus according to claim 1, wherein said storage receptacle comprising insulating material.

12. The quick chilling apparatus according to claim 11, wherein said storage receptacle further being open at the top and including a removable cover.

13. A stationary quick chilling apparatus for maintaining stationary food containers chilled, comprising:

a stationary refrigeration plant for chilling a fluid chilling medium, said refrigeration plant including a chilling medium circuit which includes means defining a chilling medium supply port for discharging said chilling medium, and means defining a chilling medium return port for accepting said chilling medium;

a fluid chilling medium comprising an aqueous liquid;

a plurality of separate stationary storage receptacles for receiving and storing containers and said chilling medium in heat exchange relation to food containers placed therein, each said stationary storage receptacle comprising an insulated bottom wall and upstanding insulated lateral walls, an interior open at the top, a plurality of dividers arranged abreast for separating said each stationary storage receptacle into at least three compartments, and at least one brace straddling said plurality of dividers for maintaining said dividers in place;

said each stationary storage receptacle having means defining an inlet port and means defining an outlet port for manual attachment of two hoses in communication with said interior of each said stationary storage receptacle;

a supply conduit connectable to said supply port of said refrigeration plant and connectable to said inlet port of each said stationary storage receptacle; and a return conduit connectable to said return port of said refrigeration plant and connectable to said outlet port of each said stationary storage receptacle, thereby enabling manual connection and disconnection of fluid communication between said refrigeration plant and each said stationary storage receptacle, and selectively establishing a chilling medium recirculation therebetween.

14. The quick chilling apparatus according to claim 13, wherein further including a flow switch for controlling said refrigeration plant responsive to detection of sufficient flow of said chilling medium.

15. The quick chilling apparatus according to claim 13, wherein further including a strainer to cleanse fluid being recirculated disposed within said chilling medium circuit.

16. The quick chilling apparatus according to claim 13, wherein said liquid further including a freeze point depressant depressing the freezing point of said liquid below that of water.

17. The quick chilling apparatus according to claim 13, wherein the stationary apparatus and the stationary receptacles constitute a bar.

18. The quick chilling apparatus according to claim 13, wherein said liquid further including a freeze point depressant depressing the freezing point of said liquid below that of water selected from the group consisting of an alkyl glycol, an alkylene glycol, a polyalkylene glycol, and mixtures thereof.

19. A quick chilling apparatus for maintaining containers chilled, comprising:

a refrigeration plant for chilling a liquid chilling medium, said refrigeration plant including a chilling medium circuit and means defining a chilling medium supply port for discharging said chilling medium;

an insulated storage receptacle for receiving and storing containers and said chilling medium in heat exchange relation to containers placed therein, said storage receptacle comprising a bottom wall, a top wall, and four upstanding walls, wherein a front wall is a door;

means defining an inlet port which is connected to a liquid to air heat exchanger positioned inside said storage receptacle, wherein said heat exchanger is connected to said chilling medium supply port;

an open tank providing for receiving and storing said containers in a recirculating chilling medium; and at least one rack means positioned above said open tank to hold foods; whereby the storage receptacle can be separated from the cooling plant by manually enabling and disconnecting fluid communication between said supply port and said cooling plant.

20. The quick chilling apparatus according to claim 19, wherein said recirculating chilling medium is an aqueous solution containing a freeze point depressant selected from the group consisting of ethylene glycol, polyethylene glycol and mixtures thereof.

* * * * *